United States Patent [19]

Edwards

[11] 4,137,896

[45] Feb. 6, 1979

[54] FIREPLACE ENCLOSURE AND HEAT-EXCHANGER UNIT

[75] Inventor: Harrison F. Edwards, Norwich, N.Y.

[73] Assignee: Sunbeam Corporation, Chicago, Ill.

[21] Appl. No.: 809,186

[22] Filed: Jun. 23, 1977

[51] Int. Cl.[2] ..... F24B 7/02; F24C 15/10

[52] U.S. Cl. ..... 126/140; 126/132; 126/202

[58] Field of Search ..... 126/132, 121, 120, 140, 126/200, 138, 202, 198, 133, 298, 201, 203, 164, 153 B, 141, 165

[56] References Cited

U.S. PATENT DOCUMENTS

| | | | |
|---|---|---|---|
| 677,542 | 7/1901 | Heitland | 126/132 X |
| 785,401 | 3/1905 | Buck | 126/120 X |
| 1,365,912 | 1/1921 | Greene | 126/121 |
| 2,161,723 | 6/1939 | Rutland | 126/121 |
| 2,622,587 | 12/1952 | Dupler | 126/121 |
| 2,671,440 | 3/1954 | Dupler | 126/121 |
| 3,938,496 | 2/1976 | Kampf et al. | 126/121 |
| 4,026,263 | 5/1977 | Boyd | 126/121 |

*Primary Examiner*—Dennis L. Taylor

*Attorney, Agent, or Firm*—H. Gibner Lehmann; K. Gibner Lehmann

[57] ABSTRACT

A combination fireplace enclosure and heat-exchanger unit for providing supplemental heat to areas external to the fireplace. The unit includes an enclosure frame having double-paned glass closure doors, and a steam-heating system disposed at the upper portion of the frame. The heating system comprises a boiler device mounted at the rear of the frame and above the fire, and a heat-exchanger device disposed at the front of the frame. The heat-exchanger device has a steam passage which is connected by a steam line to the boiler. The passage is sloped with respect to the horizontal, such that condensate from the exchanger device can flow by gravity back to the boiler device to be converted into steam. The entire system is vented to the atmosphere whereby there is no danger of pressure build-up; accordingly the need for relief valves is obviated. Means providing an inlet to the system enable measured quantities of water to be added periodically, as required. The enclosure and heat-exchanger unit are completely self-contained, and accordingly can be readily installed with a minimum of tools, and with no external plumbing connections being required.

24 Claims, 7 Drawing Figures

56
54
64
72
38
46
62
36
42
40
34
32
44
69
24
16
14
98
22
100
48
68
92
100
28
26
24
12
20
71
96
86
94
24
18
24

FIREPLACE ENCLOSURE AND HEAT-EXCHANGER UNIT

CROSS REFERENCES TO RELATED APPLICATIONS

1. Applicant's co-pending application, U.S. Ser. No. 701,689, filed July 1, 1976 and entitled COMBINATION ISOBARIC STEAM HEATER AND ENCLOSURE FOR USE WITH FIREPLACES.

2. Applicant's co-pending application, U.S. Ser. No. 797,543, filed May 16, 1977, and entitled FIREPLACE FORM AND ENCLOSURE.

BACKGROUND

This invention relates generally to heat-exchanger systems for fireplaces, and more particularly to circulation systems of the type employing one or more boiler devices, adapted to be located within the firebox.

In the past a number of heat-extraction systems have been proposed for use with fireplaces, having met with varying degrees of success. Several popular prior devices comprise those incorporating hollow gratings through which air or water is circulated. The air or water is heated by the proximity of the grate to the coals of the fire. Blowers and the like are also used with some prior units, while others employed natural convection.

One of the problems associated with most prior installations was that the efficiency of the heat-extracting process was extremely low. With forced air gratings, the fireplace has to be used without a screen or enclosure. This meant that a large quantity of air from the room was being drawn up the chimney, only to be replaced by colder air which seeped into the room from the outside, through minute cracks around doors and windows. The small amount of heat obtained from such gratings did not nearly compensate for the loss up the chimney. As a result, the overall heating efficiency of these arrangements was poor. Moreover, in systems where heat was extracted from the coals as in the case of a circulating-air type grate, the combustion temperature of the fire was significantly reduced. Accordingly, the use of such grates has been found to detract from the overall efficiency of the system, since it has been determined experimentally that less heat per pound of fuel is being produced, where such systems are employed.

Efforts to limit the flow of air from the room by the use of glass enclosures greatly increased the combustion efficiency of the fire. However, in the majority of installations heretofore known, the overall heating efficiency was still inadequate; most of the heat contained in hot gases from the fire was merely being drawn up the chimney.

Other installations involved integral heating systems comprising networks of pipes contained in the walls of the firebox, through which water was circulated to provide the necessary transfer of heat. The external plumbing often associated with such networks was aesthetically unattractive, as well as representing substantial costs involved with installation and maintenance.

SUMMARY

The above disadvantages and drawbacks of prior fireplace heat-extraction systems are obviated by the present invention which has for an object the provision of a novel and improved combination fireplace enclosure and heat-exchanger unit which can be a retro-fit device, is simple in construction, reliable in operation, and which can be readily installed by unskilled personnel in a relatively short time. A related object of the invention is to provide an improved combination retrofit unit as above, which is characterized by high heating efficiency whereby the heat from the hot gases of the fire is effectively transferred to the room while at the same time the loss of heat from the room due to convection up the chimney is greatly minimized.

Still another object of the invention is to provide an improved combination fireplace enclosure and steam-heating system which is completely self-contained, requiring no special plumbing fixtures, and requiring no alteration of the fireplace physical layout during or after installation, thereby making the unit especially adaptable for use with existing fireplace structures.

A feature of the invention is the provision of a fireplace steam-heating system which is vented to the atmosphere, thereby eliminating the need for safety valves and the like, and resulting in an extremely safe, isobaric system.

Another feature of the invention is the provision of a unit as above having a unique measuring device associated with the water inlet port, wherein predetermined quantities of water can be easily added to the system as required, to replenish that lost by vaporization.

The above objects are accomplished by the provision of a novel and improved combination fireplace enclosure and heat-exchanger unit for providing supplemental heat to areas external to a fireplace, comprising a fireplace enclosure frame and closure doors carried thereby and movable between open and closed positions, and a steam-heating system attached to the enclosure frame, for extracting heat from the hot gases of the fire. The system includes a boiler device mounted at the rear of the frame for disposition above the fire, for converting water into steam, and a heat-exchanger device also carried by the frame and having a steam passage. A steam line is provided between the boiler device and the steam passage of the exchanger device to conduct steam to the latter. Portions of the steam passage are disposed above the level of the boiler device, such that the condensate from the exchanger device can drain back to the boiler device by gravity, for subsequent heating and conversion to steam. In addition, the steam-heating system has a unique inlet means for enabling just the proper quantity of water to be added periodically to the system, to replenish that lost by vaporization.

Other features and advantages will hereinafter appear.

In the drawings, illustrating a preferred embodiment of the invention:

Figures 1, 5, 6:
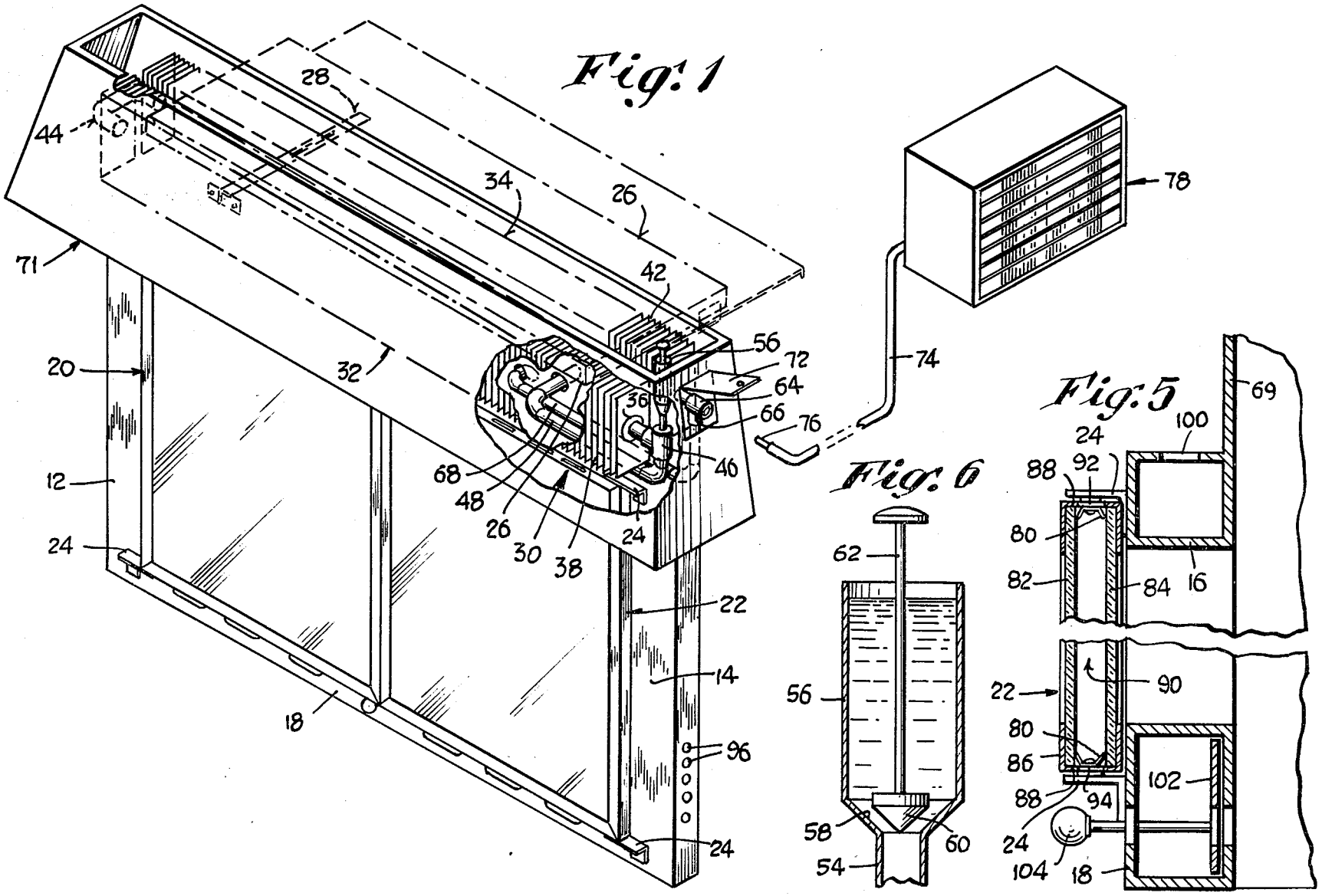
FIG. 1 is a perspective view of the improved combination fireplace enclosure and heat-exchanger unit of the present invention, with part of the hood associated therewith broken away, to reveal details of the construction.
FIG. 5 is a fragmentary vertical section of the enclosure, per se, of FIGS. 1 and 2.
FIG. 6 is a vertical section of a valved water filled cup associated with the enclosure and heat-exchanger unit of FIGS. 1 and 2.
Figure 2:
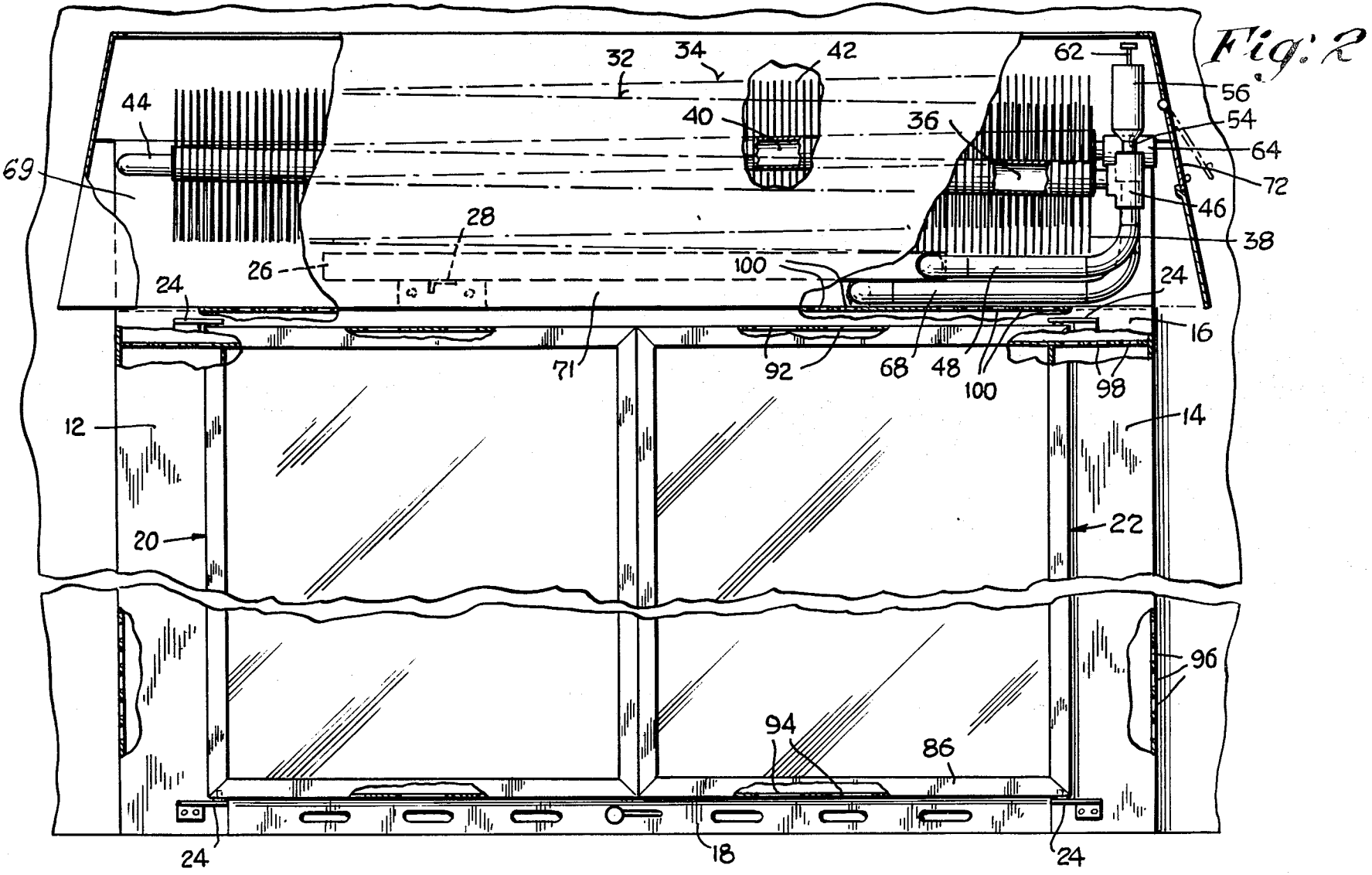
FIG. 2 is a front elevation of the fireplace enclosure and heat-exchanger unit of FIG. 1.
Figure 3:
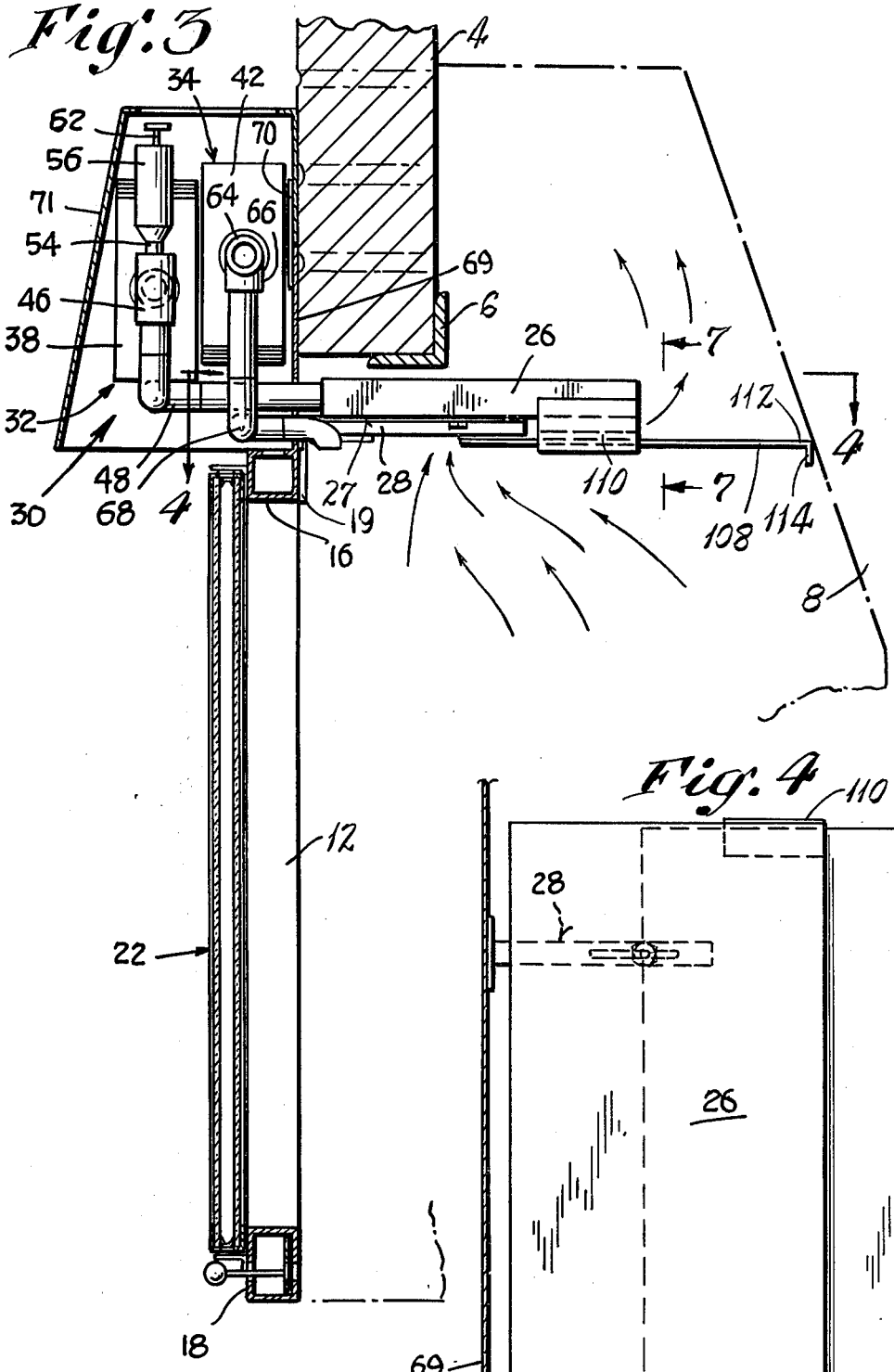
FIG. 3 is a vertical section of the enclosure and heat-exchanger unit of FIGS. 1 and 2.

Referring to FIGS. 1–3 and 5, and in accordance with the present invention there is provided a novel and improved fireplace enclosure and heat-exchanger unit combination, for providing supplemental high-efficiency heating to areas external to a fireplace. In FIG. 3, the fireplace comprises brickwork 4, a lintel bar 6, and a backwall 8. The enclosure comprises a frame having substantially vertical side members 12, 14 and horizontal top and bottom 16, 18, in conjunction with doors 20, 22 carried on hinges 24 secured to the members of the frame.

The exchanger unit includes an isobaric steam-heating system having a substantially flat boiler device or heat-collector device 26 having an expansive bottom surface 27, the boiler device 26 being mounted at the rear of the member 16 by means of a bracket 28 attached thereto. As illustrated, disposed adjacent the member 16 is a heat-exchanger device or heat-dissipating means 30 comprising two elongate radiator units 32, 34 which are generally coextensive with one another. The unit 32 includes an elongate pipe 36 and a series of heat-radiating fins 38 disposed along its length and being generally parallel to one another. Similarly, the radiator unit 34 includes an elongate pipe 40, and radiating fins 42 are carried by the pipe 40 and disposed in parallel relation along its length. At one pair of adjacent ends, the pipes 36 and 40 are joined by a U-fitting 44.

Referring again to FIGS. 1 and 2, there is provided a T-fitting 46 at one end of the pipe 36, one leg of the fitting 46 being connected to a pipe 48 extending to the boiler 26. The pipe 48 thus constitutes heat-transfer means, or means providing a steam line between the boiler device 26 and the steam passage comprising the pipes 36, 40 of the heat-exchanger device 30. The opposite leg of the T-fitting 46 extends to a line 54 which supports an upstanding measuring cup 56 particularly illustrated in FIG. 6. Associated with the cup 56 is a valve seat 58, a valve 60, and a manual operator 62. By the present invention, the cup 56 enables predetermined quantities of water to be added to the system (to the boiler device 26), as required. The capacity of the measuring cup 56 can be on the order of 50 cc. In use, with the valve 60 engaging the seat 58, the cup 56 can be filled to capacity, after which the valve 60 is unseated by means of the manual operator 62. This will result in the addition of approximately 50 cc. of water to the boiler device 26, via the passage 54, T-fitting 46, and pipe 48. It is noted that the right side of the boiler device 26 in FIG. 2 is carried by the pipe 48, which in turn is supported (through the fins 38, 42) on the member 16 by suitable brackets 19.

Referring again to FIG. 2, and by the present invention the radiator unit 32 is sloped with respect to the horizontal, with the right hand end in FIG. 2 being slightly lower than the left hand end. Similarly, the radiator unit 34 is sloped with respect to the horizontal, such that the right hand end in FIG. 2 is slightly higher than the left hand end. Such an arrangement provides for gravity flow of condensate produced in the radiators 32, 34, back to the boiler device 26. The condensate from the radiator unit 34 is seen to flow toward the left in FIG. 2, through the U-fitting 44, and toward the right through the radiator unit 32. It is returned to the boiler device 26 through the T-fitting 46 and pipe 48.

Referring again to FIGS. 1 and 2, the pipe 40 of the radiator unit 34 is connected to one leg of an additional T-fitting 64. The body 66 of the fitting extends to a drain pipe 68, the other end of which is open and disposed inside the firebox in a position underneath the location of the boiler device 26. The open end is shown in FIG. 3. The other leg of the T-fitting 64 is normally capped. Accordingly, any steam overflow from the radiator unit 34 is channeled to the drain 68, and merely vented into the firebox.

In FIG. 3, the member 16 of the frame includes an upstanding flange 69 having one or more brackets 70 which support a protective hood 71 of box-like configuration. The hood is open at both its bottom and its top, to provide for free circulation of air from the room past the radiating fins 38, 42. The hood serves two purposes. It provides an aesthetically pleasing appearance to the steam system, an also protects personnel from inadvertent contact with the hot portions of the system, namely the finned portions of the radiator units 32, 34.

As shown in FIG. 1, the hood 71 includes a flap 72 which can be raised, to expose the T-fitting 64. In the event that it is desired to employ an auxiliary radiator unit 78 for obtaining additional heat output, the cap which is normally carried on the open leg of the T-fitting 64 can be removed. A hose 74 having a nipple 76 of reduced dimension can then be inserted into the open leg of the fitting 64. Preferably, the nipple 76 is of sufficient length to close off the body 66 of the T-fitting 64. This has the effect of disconnecting the drain 68 from the system, whereby steam overflow from the radiator pipe 40 will be channeled through the hose or pipe 74 for condensation in the radiator unit 78. Such a unit 78 could be similar to that manufactured by Trane, and commercially available under the model number 42S. With an auxiliary unit 78 of this type, the hose 74 constitutes both the steam supply line and the condensate return line. Accordingly, all portions of the hose 74 must slant downwardly toward the T-fitting 64, in order to prevent pockets of water from being trapped in the hose 74, which would impede the fluid flow and result in malfunctioning of the system.

When the auxiliary radiator unit is employed, the present system operates automatically to provide heat to the auxiliary unit only when there is excess steam which has not been condensed by either the radiator 32 or 34. In the case of relatively small fires, the amount of steam produced may be insufficient to effect substantial flow into the auxiliary unit 78. However, the latter can remain connected at all times, regardless of the size of the fire, since it will not interfere with the transfer of heat to the radiator units 32, 34 during periods where relatively small fires are being employed.

I have found that the present unit can provide up to 10,000 BTU per hour of useful heat for the room, without the auxiliary unit 78. When the auxiliary unit 78 is connected as shown, an additional 40,000 BTU per hour can be obtained, assuming that a sufficiently large fire is maintained in the firebox.

As shown particularly in FIG. 5, and in accordance with the invention the door 22 consists essentially of two panes of glass 82, 84 which are disposed in spaced-apart parallel relation. Extending completely around the door 22 is a frame or sash 86 constituted as a channel member which confines and conceals the edge portions of the glass panes 82, 84. The panes 82, 84 are maintained in spaced relation by means of a series of spring clips 80 which are riveted to the connecting web portion 88 of the channel member 86. Four clips 80 are employed for the door 22, two being carried by the sash 86 adjacent the bottom member 18, and two being carried by the sash 86 adjacent the top member 16. The door 20 is of similar construction, comprising a pair of spaced apart glass panes disposed in parallel relation, and a sash similar to that designated 86 in FIGS. 2 and 5.

By virtue of the doors 20, 22 being a double pane construction, a hotter enclosed fireplace fire can be had with safety, thereby making possible the production of superheated steam in an isobaric system. The panes of glass 82, 84 and sash 86 define an air space 90 through which air can be freely convected, even when the doors 20, 22 are closed. Referring to FIG. 2, it can be seen that the web portion of the channel or sash 86 has a series of slots or ventilating holes 92 in the vicinity of the top member 16. Similarly, a second series of slots 94 is provided in the sash 86, adjacent to the bottom member 18. By such an arrangement, air occupying the space 90 becomes heated due to its proximity to the fire and glass panes 82, 84, and is consequently caused to rise and exit through the ventilating holes 92; air from the room is drawn into the holes 94 of the sash. There is thus established an upward flow of air from the room, into the air space 90, and out the ventilating holes 92 in the top of the door 22 and back into the room. The remaining door 20 is provided with ventilating holes similar to those designated 92, 94 of the door 22. Such an arrangement has been found to not only provide heat to the room, but in addition, the temperature of the glass panes 82, 84 is maintained at a safe level, due to the cooling effect of the convected air, while enabling a hotter fire to be maintained for purposes of steam superheating. Experiments have shown that the reduction in temperature of the glass panes can be as much as 200° F. by virtue of the provision of the double-pane construction having ventilating holes. Accordingly, the danger of the glass cracking where an excessively hot fire is being employed, is greatly reduced.

Also, in accordance with the invention the side members 12, 14 of the fireplace frame are of hollow construction and have the form of box sections. Referring to FIG. 1, a series of air inlet or ventilating holes 96 is provided in the side wall of the member 14. The upper end of the member 14 is open, and a series of notches or holes 98 constituting inlet ports is provided in the top member 16 where it joins the vertical side member 14. As shown in FIG. 1, this top member 16 is also in the form of a box section and includes a series of air discharge ports 100. By such an arrangement, cold air from the room can flow into the holes 96, up through the hollow interior of the vertical side member 14, through the ports 98 and out the discharge ports 100. Such an arrangement has been found to provide a desirable cooling to the enclosure frame, reducing the overall temperature to a safe value, while at the same time providing additional heat to the room.

The bottom member 18 is also constituted as a box section, and includes a shutter or slide 102 which is operated by a handle 104.

Referring again to FIGS. 1 and 5, it can be seen that the top and bottom members 16, 18, as well as the side members 12, 14 have front surfaces which lie in a common plane. The doors 20, 22 are seen to overlap the top and bottom members, as well as the side members, thus providing an improved seal over that obtainable where the doors are completely nested between the fireplace frame members. In addition, such construction enables unimpeded flow of air from the room through the ventilation holes 94 and into the air space 90 of the door 22, and out the top ventilation holes 92 (FIG. 2). Accordingly, air flow to the fire is capable of being closely controlled by means of the shutter 102. This is important in providing an optimum flow, wherein the combustion efficiency is maximized and the combustion temperature is greatest. Accordingly, the overlapping construction of the doors 20, 22 and the fireplace frame constituted of the members 12, 14, 16, 18, is seen to be an important feature of the present invention.

Figure 4:
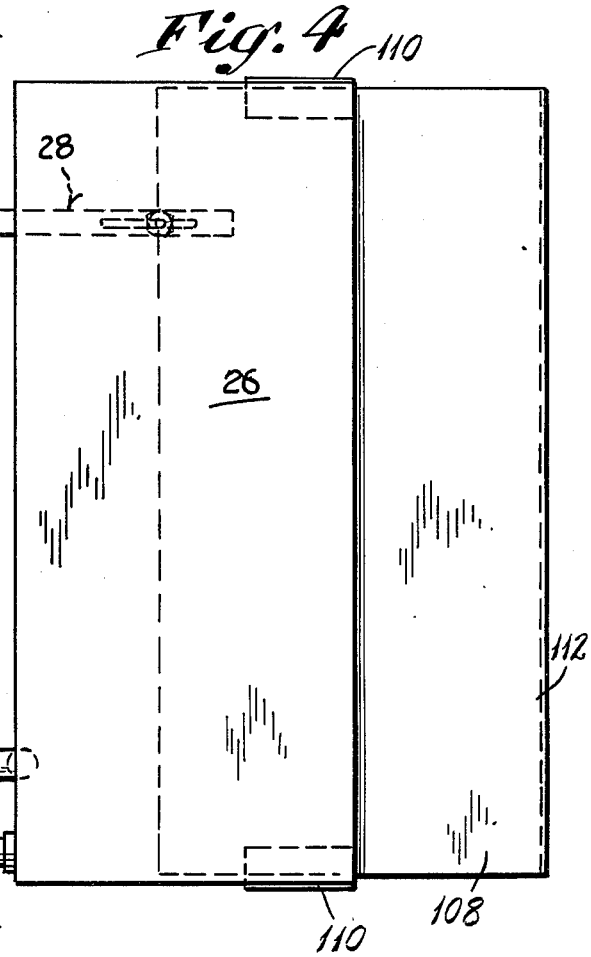
FIG. 4 is a fragmentary section taken on line 4—4 of FIG. 3.
Figure 7:
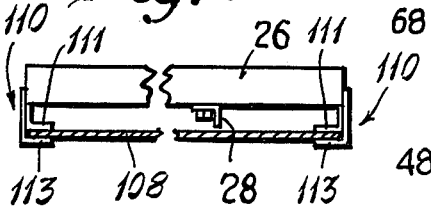
FIG. 7 is a section taken on line 7—7 of FIG. 3.

Referring now to FIGS. 1, 3 and 4 and further in accordance with the present invention there is provided a damper device in the form of a substantially flat plate 108 for channeling hot gases from the fire forwardly, toward the boiler device 26. Welded to the latter are two brackets 110 which have shoulders or flanges 111 and 113 for engagement with the opposite edge portions of the plate 108. The construction of the brackets is shown in FIG. 7. Each bracket can be constituted as a pair of angular members which are welded together as shown, to provide channels formed by the flanges 111 and 113, in which the opposite edge portions of the plate 108 are slidably received. The rear edge portion 112 of the plate includes a small flange 114 as shown in FIG. 3, for added stiffness. Accordingly, plate 108 can be slidably adjusted with respect to the boiler device 26 to a position wherein it engages the back wall 8 of the fireplace. By such an arrangement, hot gases from the fire are directed toward the boiler device in FIG. 3, and thereafter parallel to the expansive surface 27 thereof and through the space between it and the upper surface of the plate 108. The spacing between the plate and the lower surface of the boiler device 26 can be on the order of one or two inches, depending on the size of the boiler device and the sufficiency of the draw up the chimney. Such flow is illustrated by a series of arrows shown in FIG. 3. In the event that excess smoke is being produced, and the draw up the chimney is sluggish, the plate 108 can be shifted slightly toward the left in FIG. 3, wherein there exists a small space between the flange 114 and back wall 8, so as to improve the flow. However, this will not materially affect the heat transfer to the boiler device 28.

I have found that the provision of the plate 108 not only increases the efficiency of the heat-exchanging process of the heat-exchanger unit by causing the hot gases to follow a serpentine route adjacent the large surface of the boiler device, but in addition it causes more complete combustion of any unburned gases which came in contact with the plate. Since the plate is not thermally coupled to any heat sink, it tends to reach a very high temperature after a period of operation. Volatile gases which are produced in the fire come in contact with the plate, and further burning of such gases occurs. Accordingly, the percentage of unburned gases going up the chimney is reduced, resulting in a reduction in the formation of creosotes and tars on the inner walls of the chimney.

From the above it can be seen that I have provided a novel and improved combination fireplace enclosure and integral isobaric heat-exchanger unit which is simple in construction and reliable in operation, even over extended periods of use. The provision of double-paned, ventilated doors on the enclosure enables an especially hot fire to be used, for the production of super-heated steam in the boiler device. Such production of superheated steam has been found to be feasible, even though the entire system is vented to the atmosphere. No danger of cracking of the glass panes is present, since the ventilation provided will maintain the temperature at safe levels, even where relatively large fires are employed.

Because the heat-exchanger unit is directly carried by the enclosure, virtually no modification of the existing structure of the fireplace is required. Accordingly, installation is readily accomplished by sliding the system into position, and merely securing the enclosure frame to the lintel or the brickwork, with suitable brackets (not shown). The overall installation cost is therefore low, there being no special tools required.

The device is thus seen to represent a distinct and advance improvement in the technology of fireplace heating systems.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. A combination fireplace enclosure and heat-exchanger unit for providing supplemental heat to areas external to a fireplace, comprising in combination:
   (a) a fireplace enclosure frame and closure doors carried thereby and movable between open and closed positions,
   (b) a steam-heating system attached to said enclosure frame, said system being vented to the atmosphere and including:
      (1) a boiler device adapted to convert water into steam,
      (2) a heat-exchanger device carried on said frame and having a steam passage,
      (3) means providing a steam line between the boiler device and the steam passage of said exchanger device, to conduct steam to the latter for condensation therein,
      (4) substantial portions of said steam passage being disposed above the level of the boiler device,
      (5) said steam-heating system providing for gravity drainage of condensate back to the boiler device for subsequent heating and conversion to steam,
      (6) said steam-heating system having inlet means for enabling water to be added periodically thereto, in order to replenish that lost by vaporization, and
   (c) means mounting the boiler device to the rear of said frame for disposition above the fire in the fireplace.

2. The invention as defined in claim 1, wherein:
   (a) said boiler device is constituted as a substantially flat, elongate boiler chamber disposed in a substantially horizontal plane transverse to the plane of the enclosure frame,
   (b) said boiler device mounting means comprising a bracket affixed to the rear surface of the frame,
   (c) said heat-exchanger device comprising a pair of elongate radiator units, each radiator unit having an elongate pipe and a series of radiating fins connected therewith and spaced along its length, the elongate pipes of the radiator units constituting said steam passage, said radiator units being disposed adjacent to the top of the enclosure frame,
   (d) means connecting said pipes to one another at one pair of adjacent ends,
   (e) said pipes being sloped with respect to the horizontal, whereby condensate from one pipe can run to one end thereof, empty into the other pipe and run toward the other end thereof, to be returned to the boiler device,
   (f) said inlet means comprising an upstanding measuring cup and a passage connected with said cup and said boiler device,
   (g) said cup having a valve seat at its juncture with said passage, and
   (h) a manually operable valve cooperable with said valve seat for controlling the flow through said passage whereby the cup can be filled with the valve closed, and thereafter the valve opened to introduce a measured amount of water into the boiler device.

3. The invention as defined in claim 1, wherein:
   (a) said heat-exchanger device comprises a pair of elongate radiator units each having an elongate pipe and a series of radiating fins connected therewith and spaced along its length, said radiator units being disposed adjacent to the top of the enclosure frame, the elongate pipes of the radiator units constituting said steam passage,
   (b) means connecting said pipes to one another at one pair of adjacent ends,
   (c) said pipes being sloped with respect to the horizontal whereby condensate from said pipes can flow by gravity to the boiler device to be re-converted into steam.

4. The device as defined in claim 1, wherein:
   (a) said boiler device mounting means comprises a bracket carried by the rear of the enclosure frame and secured to the boiler device.

5. The device as defined in claim 1, wherein:
   (a) said inlet means comprises an upstanding measuring cup and a passage connected with said cup and said boiler device,
   (b) said cup having a valve seat, and
   (c) a manually operable valve cooperable with said valve seat for controlling the flow through said passage, whereby the cup can be filled with the valve closed, and thereafter the valve opened to introduce a measured amount of water into the boiler device.

6. The device as defined in claim 1, and further including:
   (a) an additional heat-exchanger device, adapted to be located remotely from the enclosure frame, and
   (b) means providing a steam line and a condensate return line between said steam-heating system and said additional heat-exchanger device,
   (c) condensate from the additional heat-exchanger device returning by gravity to the boiler device, to be re-converted into steam.

7. The device as defined in claim 1, and further including:
   (a) means connected with the steam passage of said heat-exchanger device, for channeling steam overflow from the latter to be exhausted through an exhaust line into the firebox of the fireplace.

8. The device as defined in claim 1, and further including:
   (a) a hood carried by the upper portion of the enclosure frame and partially surrounding the heat-exchanger device,
   (b) said hood being open at its top and bottom to enable free flow of air circulating in the room past the heat-exchanger device while at least partially concealing it from view and protecting personnel in the room from direct contact therewith.

9. The invention as defined in claim 1, and further including:

(a) an additional heat-exchanger device, adapted to be located remotely from the enclosure frame, (b) means providing a steam and condensate return line to said additional heat-exchanger device, (c) condensate from the additional heat-exchanger device returning by gravity to the boiler device, to be re-converted into steam, and (d) means connected with the steam passage of said first heat-exchanger device, for channeling steam overflow from the latter to be exhausted through an exhaust line into the firebox of the fireplace, (e) said line providing means for the additional heat-exchanger device inactivating said steam overflow channeling means, when the additional heat-exchanger device is used, thereby directing steam overflow from the first heat-exchanger device into said additional heat-exchanger device instead of allowing it to be exhausted into the firebox.

10. The invention as defined in claim 1, wherein:

(a) said inlet means includes a measuring device and a manual operator, for adding predetermined quantities of water to the boiler device to replenish that lost by vaporization.

11. The invention as defined in claim 7, wherein:

(a) said channeling means comprises a T-fitting having its body connected with said exhaust line, (b) one leg of the T-fitting being connected with the steam passage of the heat-exchanger device, (c) an additional heat-exchanger device, adapted to be located remotely from the enclosure frame, and (d) means providing a steam and condensate return line from the other leg of the T-fitting to said additional heat-exchanger device.

12. The invention as defined in claim 11, wherein:

(a) said steam and condensate return line providing means includes a nipple adapted to be inserted into said other leg of the T-fitting, (b) insertion of said nipple into the T-fitting closing off the body of the latter whereby any excess steam from the first heat-exchanger device is directed to the additional heat-exchanger device and not out the exhaust line.

13. The invention as defined in claim 1, wherein:

(a) each of said closure doors comprises a rectangular sash and a pair of tempered glass panes carried by the sash and disposed in parallel relation, (b) means for maintaining said pairs of panes in spaced relation with one another, (c) said sash having multiple ventilating openings enabling air from the room to be drawn into the space between the pairs of panes, become heated, and thereafter be returned to the room.

14. The invention as defined in claim 1, wherein:

(a) said frame comprises two vertical frame members and a horizontal frame member, (b) said vertical members each being of hollow construction, having an inner air chamber, and having multiple air inlet passages in their lower portions, to draw air from the room into the respective chamber, (c) the horizontal frame member being of hollow construction, having an inner air chamber communicating with the air chambers of the vertical members, and further having multiple air outlet passages for returning heated air from said chambers to the room.

15. The invention as defined in claim 8, and further including:

(a) an additional heat-exchanger device, adapted to be located remotely from the enclosure frame, (b) means providing a steam and condensate return line to said additional heat-exchanger device, (c) said hood having an opening through which the line providing means for the additional heat-exchanger device passes.

16. The invention as defined in claim 15, and further including:

(a) means on the hood providing a flap to close off said opening when the additional heat-exchanger device is not used.

17. The invention as defined in claim 1, wherein:

(a) said frame comprises two vertical frame members and a horizontal frame member, (b) said closure doors, when closed, overlapping said frame members an extent, to minimize leakage of air from the room into the firebox.

18. The invention as defined in claim 13, wherein:

(a) said frame comprises two vertical frame members and a horizontal frame member, (b) said closure doors, when closed, overlapping said frame members an extent, to provide clearance at the locations of the ventilating openings in the doors, for enabling free convection of air from the room through the area between the panes of each door.

19. A combination unitary, retro-fit fireplace enclosure and heating means for providing supplemental heat to areas external to a fireplace, comprising in combination:

(a) a fireplace enclosure frame and closure doors carried thereby and movable between open and closed positions, (b) a heat-exchanger system attached to said enclosure frame, said system including:

(1) a heat-collector device, (2) heat-transfer means carried on said frame and connected with said collector device, (3) said heat-exchanger system having heat-dissipating means mounted at the front of said frame and connected with said heat-transfer means, (4) said heat-transfer means comprising a fluid heat-transfer medium which circulates through said collector device and through said heat-dissipating means, and which is essentially held captive by the heat-exchanger system, (c) means mounting the heat-collector device to the rear of said frame for disposition above the fire in the fireplace, and (d) venting means connected with the heat-exchanger system, providing for escape of controlled quantities of said heat-transfer medium.

20. The invention as defined in claim 19, and further including:

(a) means associated with said heat-exchanger system for channeling hot gases from the fire toward the collector device so as to maximize heat-transfer thereto.

21. The invention as defined in claim 26, wherein:

(a) said adjustable means comprises a pair of brackets having shoulders slidingly engageable with edge portions, respectively of said plate.

22. The invention as defined in claim 26, wherein:

(a) said plate is disposed in a generally horizontal plane, (b) the rear edge portion of said plate being adapted to engage the backwall of the fireplace, so as to channel the hot gases from the fire in a forward direction, toward the collector device.

23. A combination unitary, retro-fit fireplace enclosure and heating means for providing supplemental heat to areas external to a fireplace, comprising in combination:

(a) a fireplace enclosure frame and closure doors carried thereby and movable between open and closed positions, (b) a heat-exchanger system attached to said enclosure frame, said system including:

(1) a heat-collector device, (2) heat-transfer means carried on said frame and connected with said collector device, (3) said heat-exchanger system having heat-dissipating means mounted at the front of said frame and connected with said heat-transfer means, (c) means mounting the heat-collector device to the rear of said frame for disposition above the fire in the fireplace, and (d) means associated with said heat-exchanger system for channeling hot gases from the fire toward the collector device so as to maximize heat-transfer thereto, (e) said collector device having an expansive heat-absorbing surface, (f) said channeling means being so disposed as to direct hot gases from the fire in a path generally parallel to said surface, so as to maximize the contact between the latter and the hot gases.

24. A combination unitary, retro-fit fireplace enclosure and heating means for providing supplemental heat to areas external to a fireplace, comprising in combination:

(a) a fireplace enclosure frame and closure doors carried thereby and movable between open and closed position, (b) a heat-exchanger system attached to said enclosure frame, said system including:

(1) a heat-collector device, (2) heat-transfer means carried on said frame and connected with said collector device, (3) said heat-exchanger system having heat-dissipating means mounted at the front of said frame and connected with said heat-transfer means, (c) means mounting the heat-collector device to the rear of said frame for disposition above the fire in the fireplace, (d) means associated with said heat-exchanger system for channeling hot gases from the fire toward the collector device so as to maximize heat-transfer thereto, (e) said channeling means comprising an expansive plate, and (f) adjustable means mounting said plate adjacent the collector device, such that the plate can be set to different operative positions with respect to said device.

* * * * *